US006716076B2

(12) United States Patent
Gokan et al.

(10) Patent No.: US 6,716,076 B2
(45) Date of Patent: Apr. 6, 2004

(54) OUTPUT SHAFT STRUCTURE OF PERSONAL WATERCRAFT

(75) Inventors: Yoshitsugu Gokan, Saitama (JP); Takaharu Kurosaki, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/190,586

(22) Filed: Jul. 9, 2002

(65) Prior Publication Data

US 2003/0017764 A1 Jan. 23, 2003

(30) Foreign Application Priority Data

Jul. 19, 2001 (JP) ..... 2001-219318

(51) Int. Cl.[7] ..... B63H 23/34
(52) U.S. Cl. ..... 440/83; 440/75; 464/179
(58) Field of Search ..... 440/38, 75, 83, 440/111, 112; 123/192.1, 192.2; 464/104, 105, 179, 182, 183

(56) References Cited

U.S. PATENT DOCUMENTS 4,722,707 A * 2/1988 Murase ..... 440/38
4,813,898 A * 3/1989 Nakase et al. ..... 440/111
5,282,444 A * 2/1994 Ito et al. ..... 123/192.2
5,405,276 A * 4/1995 Kato ..... 440/38
5,558,549 A * 9/1996 Nakase et al. ..... 440/88 L
6,394,860 B1 * 5/2002 Nanami et al. ..... 440/88 R
6,475,046 B2 * 11/2002 Muramatsu et al. ..... 440/88 R
6,488,553 B2 * 12/2002 Bourret ..... 440/83
6,537,115 B2 * 3/2003 Suganuma et al. ..... 123/198 C
2003/0075089 A1 * 4/2003 Matsuda et al. ..... 114/55.5

FOREIGN PATENT DOCUMENTS

JP 2880691 B2 1/1999
JP 2002227696 A * 8/2002 ..... F02D/41/22

* cited by examiner

*Primary Examiner*—S. Joseph Morano
*Assistant Examiner*—Ajay Vasudeva
(74) *Attorney, Agent, or Firm*—Birch, Stewart, Kolasch & Birch, LLP

(57) ABSTRACT

To provide an output shaft structure of a personal watercraft, which is capable of enhancing the durability of the engine. An engine is mounted on a watercraft body with a crankshaft extending in the longitudinal direction of the watercraft body. A shaft of a propulsion device is coupled to a rear end of the crankshaft in such a manner as to be disposed on an extension of the crankshaft. The crankshaft is supported by an engine case via plain metal. An output shaft is provided separately from the crankshaft and is coupled to the rear end of the crankshaft. The shaft of the propulsion device is coupled to the rear end of the output shaft. The output shaft is supported by the engine case via rolling bearings immovable in a thrust direction. A spline is formed on or in each of the rear end of the crankshaft and the front end of the output shaft, and a spline to be engaged with these splines is formed in or on an inner surface of a connection pipe. The rear end of the crankshaft is coupled to the front end of the output shaft via the connection pipe. A gap is formed between opposed faces of the rear end of the crankshaft and the front end of the output shaft.

14 Claims, 10 Drawing Sheets

OUTPUT SHAFT STRUCTURE OF PERSONAL WATERCRAFT

CROSS-REFERENCE TO RELATED APPLICATIONS

This nonprovisional application claims priority under 35 U.S.C. § 119(a) on Patent Application No. 2001-219318 filed in Japan on Jul. 19, 2001, the entirety of which is hereby incorporated by reference.

BACKGROUND OF THE INVENTION

1. Field of the Invention

The present invention relates to an output shaft structure of a personal watercraft.

2. Description of Background Art

Two-cycle engines have been used as power sources of general personal watercrafts. In recent years, however, to meet a requirement to lower environmental pollution and reduce noise, personal watercrafts using four-cycle engines as power sources have been proposed (see Japanese Patent No. 2880691).

Since integral type crankshafts are generally used for four-cycle engines, plain metal is used as bearings for the crankshafts.

In personal watercrafts of this type, as shown in FIGS. 10(*a*) and 10(*b*) of the present invention, an engine 1 is mounted on a watercraft body 2 with a crankshaft 1*a* of the engine 1 extending along the longitudinal direction of the watercraft body 2. A shaft 3*a* of a propulsion device (for example, a jet pump) 3 is coupled via a coupling 4 to a rear end 1*b* of the crankshaft 1*a* in such a manner as to be disposed on an extension of the crankshaft 1*a*.

Accordingly, power from the crankshaft of the engine 1 is transmitted to the propulsion device via the shaft 3*a* of the propulsion device 3, to propel the watercraft body 2.

In the personal watercraft as shown in FIGS. 10(*a*) and 10(*b*), a reaction force from the propulsion device 3 is transmitted to the crankshaft 1*a* of the engine 1.

To be more specific, the crankshaft la receives an anti-torque, a thrust force, a bending force (for deflecting the crankshaft), and vibration from the shaft 3*a* of the propulsion device 3 via the coupling 4. These forces and vibration are applied in a complex combination to the crankshaft 1*a*.

In the conventional personal watercraft as shown in FIGS. 10(*a*) and 10(*b*), if a two-cycle engine is used as the power source, there occurs no problem. This is because a crankshaft of the two-cycle engine is of a built-up type and uses a ball bearing having high durability as a bearing therefor.

In the conventional personal watercraft as shown in FIGS. 10(*a*) and 10(*b*); however, if a four-cycle engine is used as the power source, there occurs a problem. The reason for this is that since a crankshaft of the four-cycle engine is of an integral type and plain metal is used as a bearing therefor as described above, the above-described anti-torque, thrust force, bending force, and vibration are applied in a complex combination to the crankshaft. Accordingly, the crankshaft rotating at a high speed causes torsion, compression, bending (deflection), and vibration in complex combination. This results in the fatigue of the plain metal becoming severe, to degrade durability of the engine.

SUMMARY OF THE INVENTION

An object of the present invention is to solve the above-described problem and to provide an output shaft structure of a personal watercraft, which is capable of enhancing durability of an engine.

To achieve the above object, according to a first aspect of the present invention, there is provided an output shaft structure of a personal watercraft, wherein an engine is mounted on a watercraft body with a crankshaft of the engine extending in the longitudinal direction of the watercraft body. A shaft of a propulsion device is coupled to a rear end of the crankshaft of the engine in such a manner as to be disposed on an extension of the crankshaft. The crankshaft is supported by an engine case via plain metal. This output shaft structure includes an output shaft, which is provided separately from the crankshaft and is coupled to the rear end of the crankshaft. The shaft of the propulsion device is coupled to a rear end of the output shaft. The output shaft is supported by the engine case via a rolling bearing, which is immovable in a thrust direction.

With the above construction according to the first aspect of the present invention, a thrust force from the shaft of the propulsion device is mainly received by the output shaft and the rolling bearing. Therefore, the thrust force is not directly applied to the crankshaft. However, if the thrust force is applied to the crankshaft, it is transmitted thereto indirectly (in a moderated state).

Since the output shaft provided separately from the crankshaft is coupled to the rear end of the crankshaft and the shaft of the propulsion device is coupled to the rear end of the output shaft, an anti-torque, a bending force, and vibration from the shaft of the propulsion device are not directly applied to the crankshaft. However, if applied to the crankshaft, they are transmitted thereto indirectly (in a moderated state). In particular, a bending force applied to the crankshaft is significantly reduced.

As a result, according to the output shaft structure of a personal watercraft according to the first aspect of the present invention, it is possible to reduce fatigue of the plain metal for supporting the crankshaft, and hence to improve the durability of the engine.

According to a second aspect of the present invention, a spline is formed on or in the rear end of the crankshaft. Furthermore, a spline is formed on or in the front end of the output shaft. A spline for engageing with the splines is formed in or on an inner surface of a connection pipe. The rear end of the crankshaft is coupled to the front end of the output shaft via the connecting pipe.

With the above construction according to the second aspect of the present invention, it is possible to certainly transmit power from the crankshaft to the output shaft via the connection pipe.

An anti-torque, a bending force, and vibration from the shaft of the propulsion device are transmitted from the output shaft to the crankshaft via the connection pipe. In this case, since each of the crankshaft and the output shaft is coupled to the connection pipe by a spline-fitting, the reaction force, particularly, the bending force and vibration can be significantly reduced in the course of transmission from the output shaft to the crankshaft via the connection pipe.

As a result, according to the output shaft structure of a personal watercraft according to the second aspect of the present invention, it is possible to certainly transmit a power from the crankshaft to the output shaft via the connection pipe and to improve durability of the engine.

According to a third aspect of the present invention, a gap is formed between opposed faces of the rear end of the crankshaft and the front end of the output shaft.

With the above construction according to the third aspect of the present invention, an anti-torque, a thrust force, a bending force, and vibration, particularly, a thrust force and a bending force can be significantly reduced. Accordingly, it is possible to more certainly improve the durability of the engine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, an embodiment of the present invention will be described with reference to the accompanying drawings.

Figure 1:
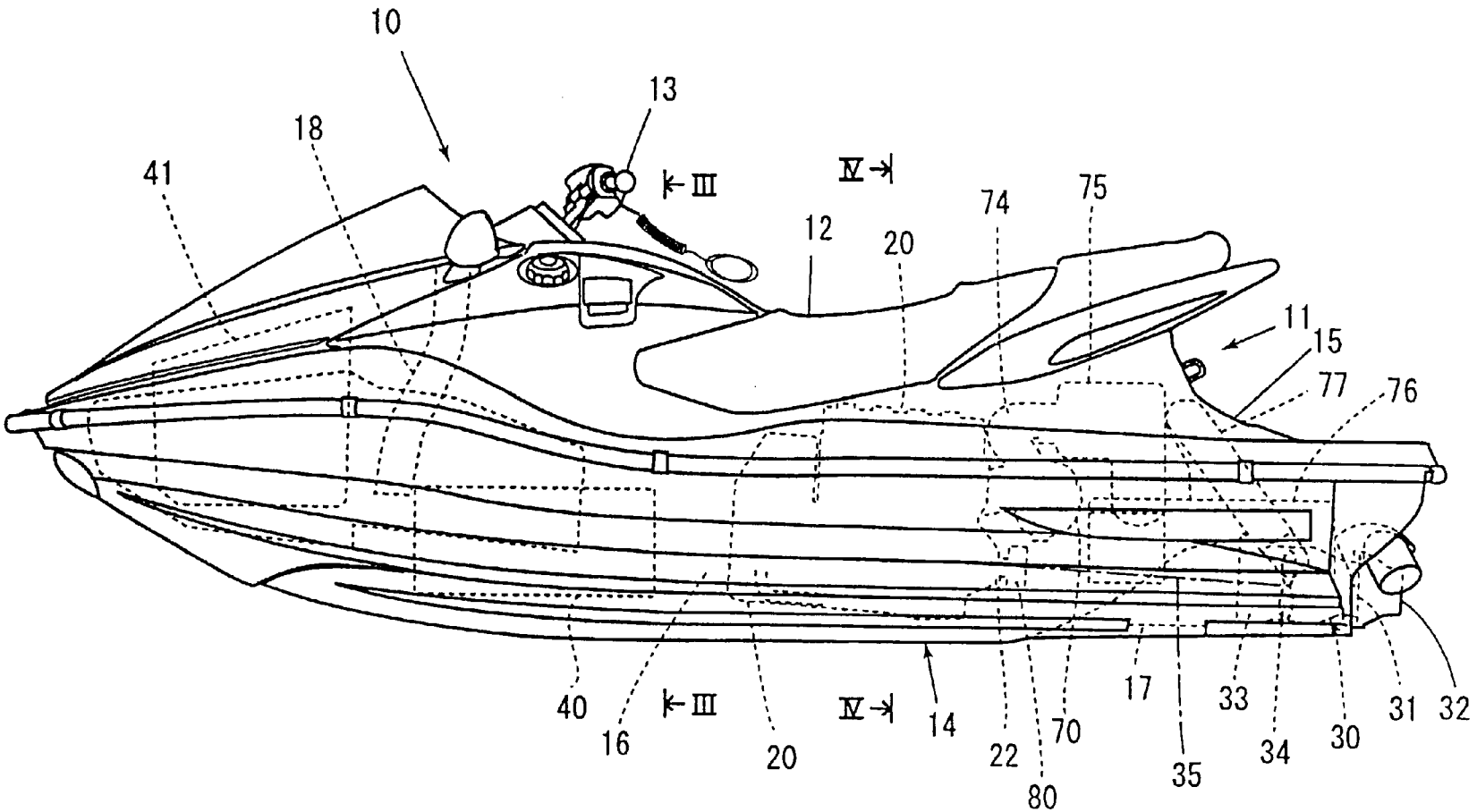
FIG. 1 is a schematic side view showing one example of a personal watercraft to which one embodiment of an output shaft structure of a personal watercraft according to the present invention is applied.
Figure 2:
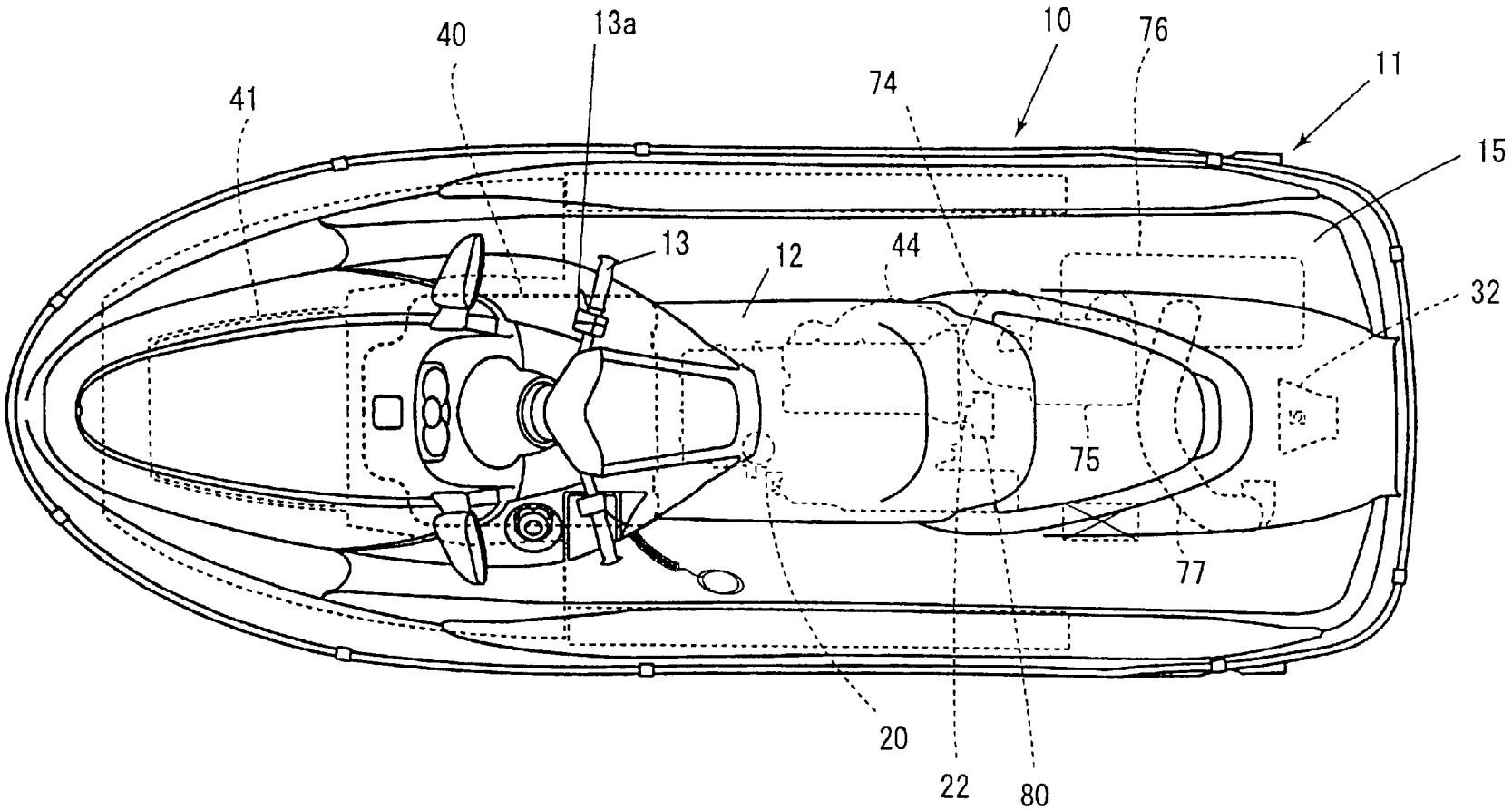
FIG. 2 is a plan view of the personal watercraft of FIG. 1.
Figure 3:
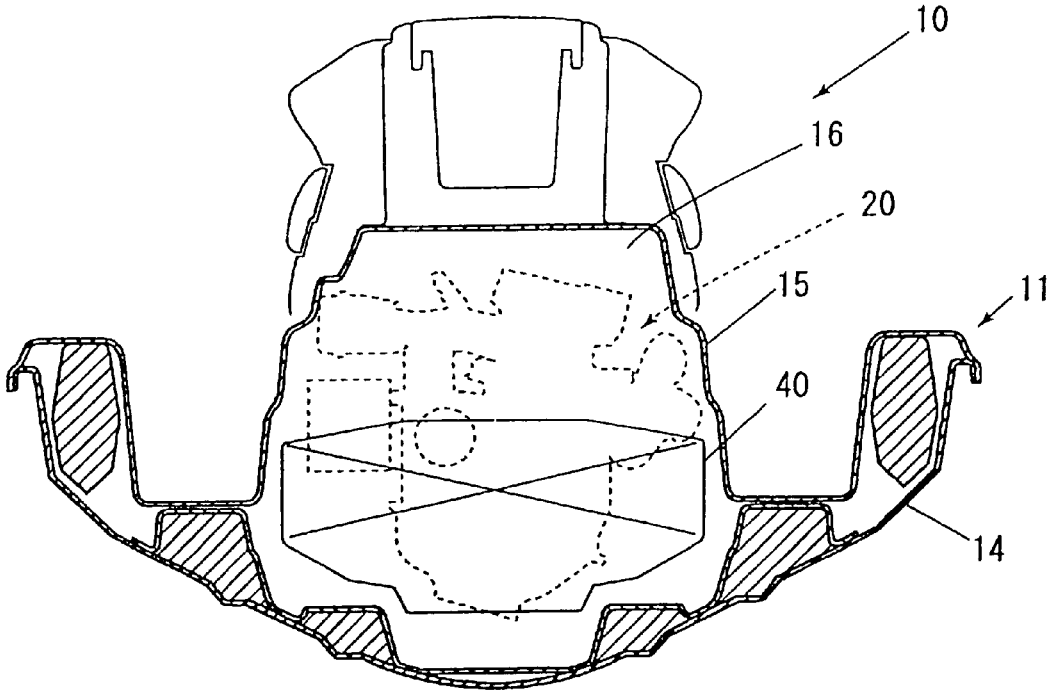
FIG. 3 is a partial, enlarged sectional view taken on line III—III of FIG. 1 (with parts partially omitted)

FIG. 1 is a schematic side view showing one example of a personal watercraft to which one embodiment of an output shaft structure of a personal watercraft according to the present invention is applied. FIG. 2 is a plan view of the personal watercraft of FIG. 1. FIG. 3 is a partial, enlarged sectional view taken on line III—III of FIG. 1 (with parts partially omitted).

Referring to these figures (particularly to FIG. 1), a personal watercraft 10 is a small saddle type watercraft, which is operable by a driver who sits on a seat 12 disposed on a watercraft body 11 and holds a steering handlebar 13 provided with a throttle lever.

The watercraft body 11 has a floating structure, wherein a hull 14 is joined to a deck 15 to form a space 16 therein. In the space 16, an engine 20 is mounted on the hull 14 with a crankshaft 21 (see FIG. 6) extending in the longitudinal direction of the watercraft body 11. A jet pump or jet propulsion pump 30 functioning as a propulsion device driven by the engine 20 is provided on a rear portion of the hull 14. An intake duct 18 for supplying intake air in the watercraft body 11 (space 16) is provided in the watercraft body 11.

The jet pump 30 has a flow passage 33 extending from a water inlet 17 opened in a bottom shell to both a jet port 31 opened in a rear end portion of the hull 14 and a nozzle 32. An impeller 34 is disposed in the flow passage 33. A shaft 35 of the impeller 34 is coupled to an output shaft 22 (to be described below) of the engine 20 via a coupling 80. When the impeller 34 is rotated by drive of the engine 20, water taken in via the water inlet 17 is jetted from the jet port 31 via the nozzle 32, to propel the watercraft body 11. A rotational speed of the engine 20, that is, a propelling force of the jet pump 30 is controlled by a turning operation of a throttle lever 13*a* (see FIG. 2) of the steering handlebar 13. The nozzle 32 is coupled to the steering handlebar 13 via a steering wire (not shown), and is turned by operation of the steering handlebar 13, to change a running direction of the watercraft body 11.

In the figures, reference numeral 40 denotes a fuel tank, and reference numeral 41 denotes a containing chamber.

Figure 4:
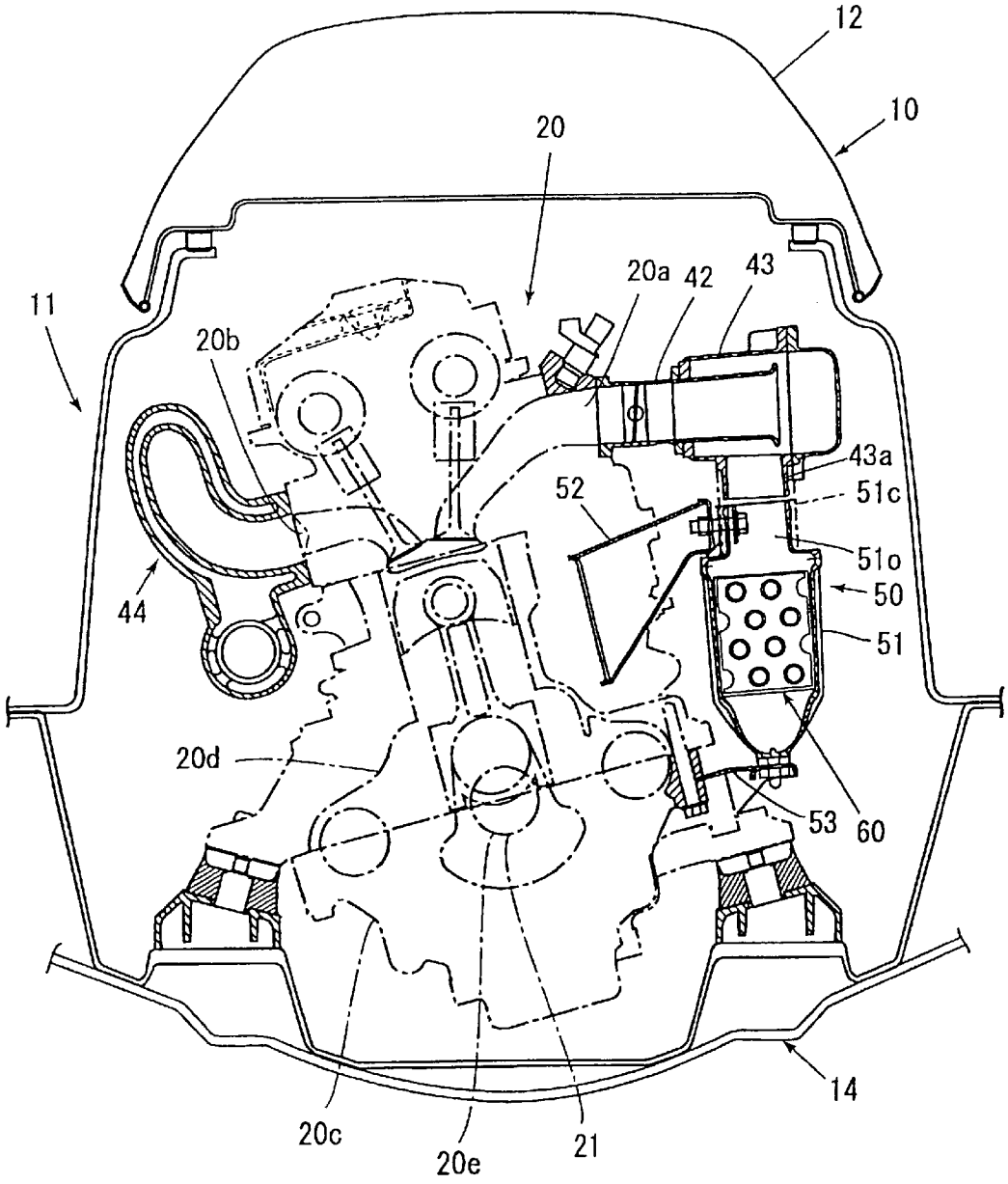
FIG. 4 is a view mainly showing the engine 20, which is a partial, enlarged sectional view taken on line IV—IV of FIG. 1 (with parts partially omitted)
Figure 5:
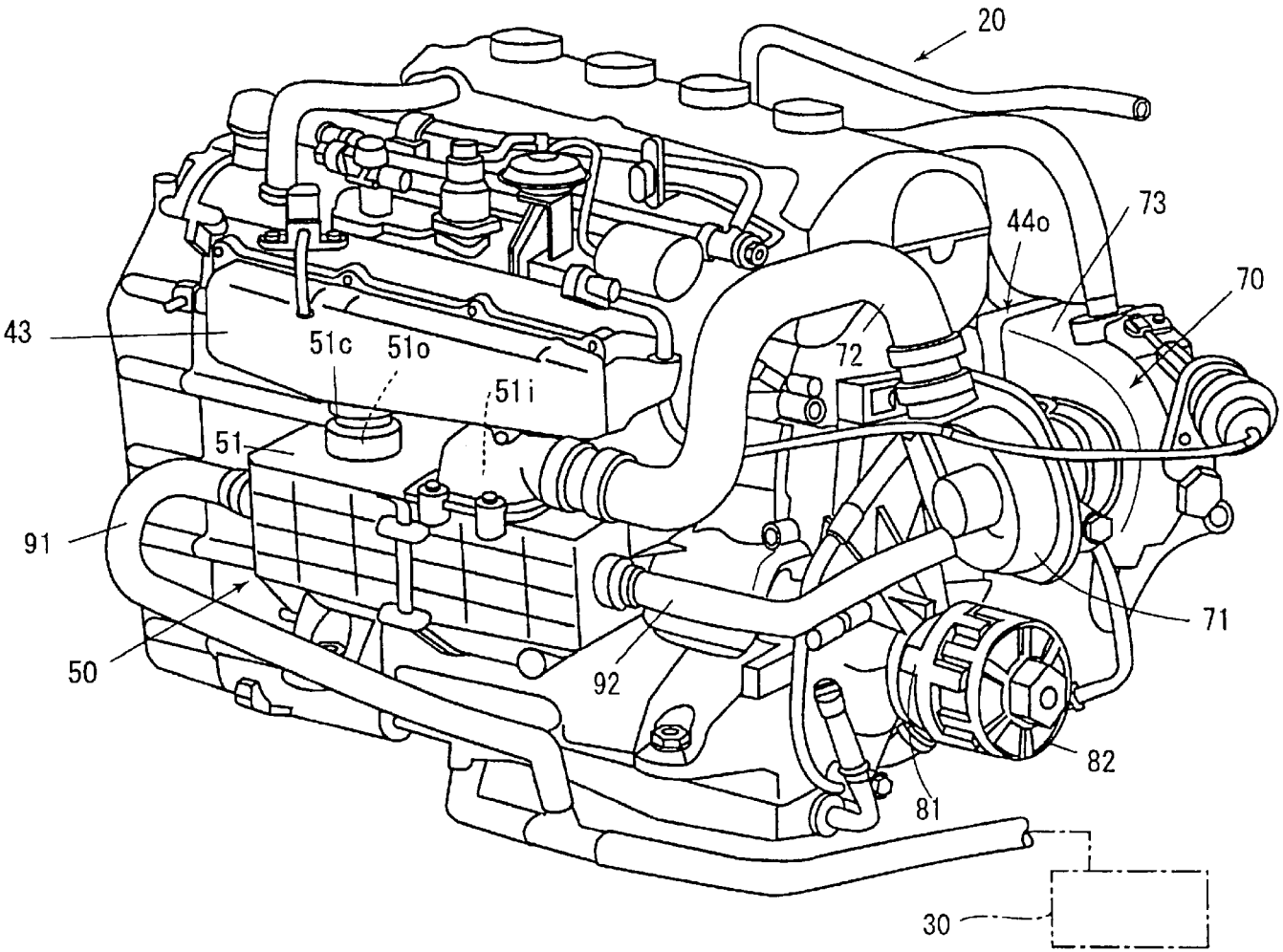
FIG. 5 is a schematic perspective view of the engine 20 as seen from an obliquely rearward direction.
Figure 6:
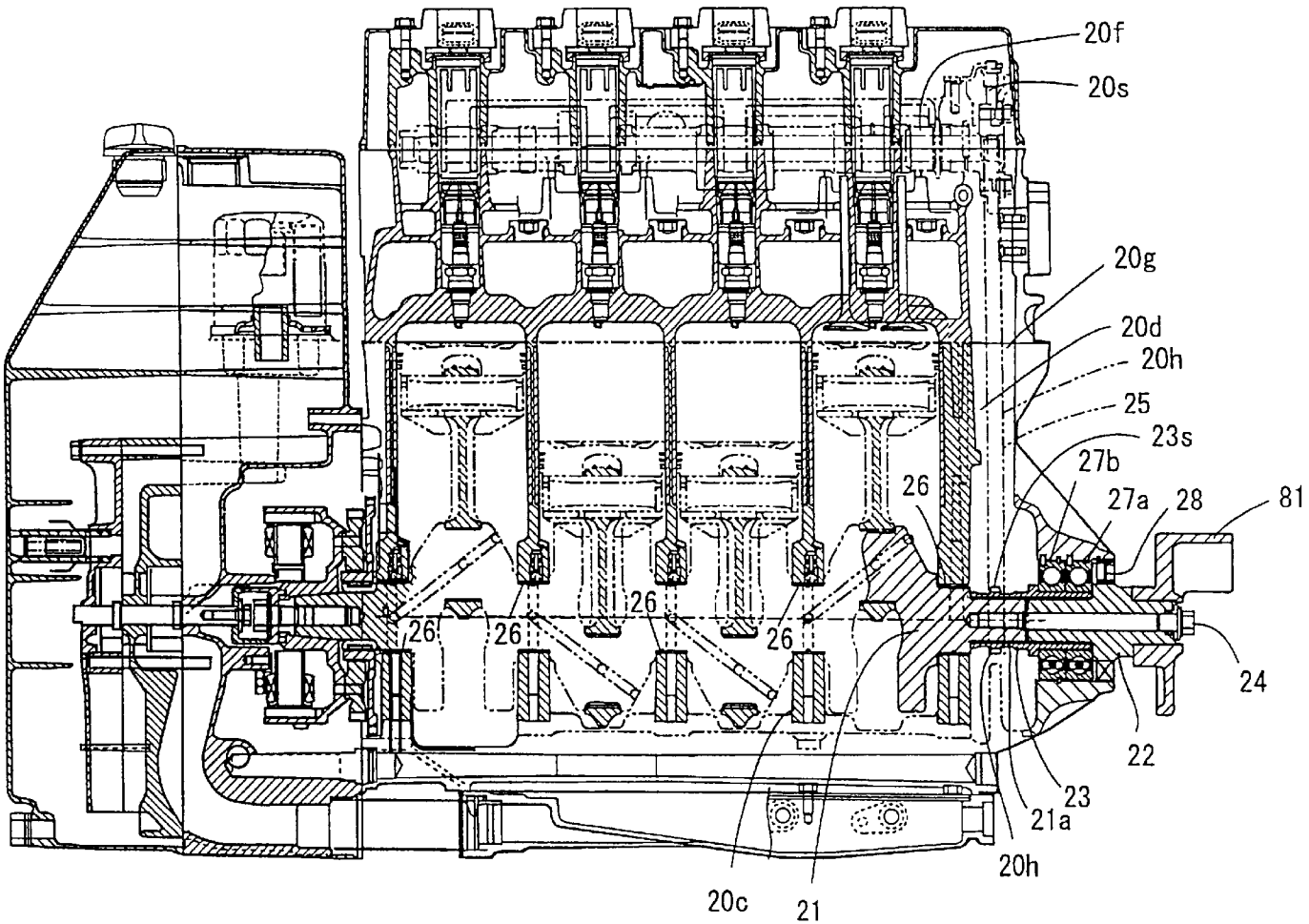
FIG. 6 is a sectional side view of the engine 20.
Figure 7:
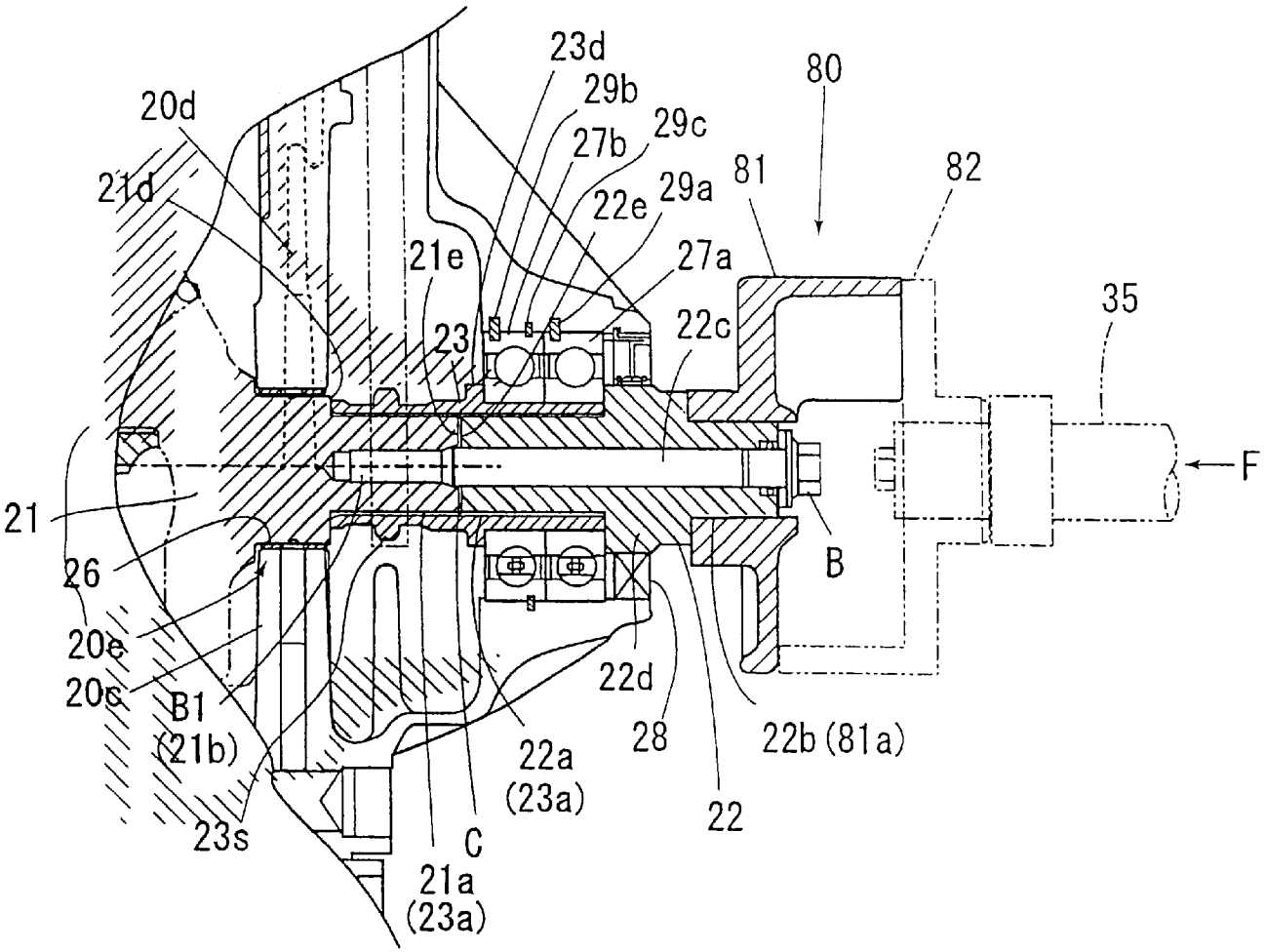
FIG. 7 is a partial, enlarged view of FIG. 6.

FIG. 4 is a view mainly showing the engine 20, which is a partial, enlarged sectional view taken on line IV—IV of FIG. 1 (with parts partially omitted). FIG. 5 is a schematic perspective view of the engine 20 as seen from an obliquely rearward direction. FIG. 6 is a sectional side view of the engine 20. FIG. 7 is a partial, enlarged view of FIG. 6.

The engine 20 is a DOHC type in-line four-cylinder/four-cycle engine. As is apparent from FIGS. 1 and 4, the crankshaft 21 of the engine 20 extends along the longitudinal direction of the watercraft body 11. Referring to FIG. 4, an intake port 20*a* is disposed on a left side of the engine 20 in the running direction of the watercraft body 11. An exhaust port 20*b* is disposed on a right side of the engine 20 in the running direction of the watercraft body 11.

A throttle body 42 and a surge tank (intake chamber) 43 are connected to the intake port 20*a*. An inter-cooler 50 disposed immediately under the surge tank 43 is connected to the surge tank 43. In FIG. 4, reference numerals 52 and 53 denote mounting brackets of the inter-cooler 50. the mounting brackets 52 and 53 are mountable to the engine 20.

The inter-cooler 50 includes, as shown in FIGS. 4 and 5, a case 51 having an intake inlet 51*i* and an outlet 51*o*, and a cooling unit 60. The intake inlet 51*i* is connected and communicated, via piping 72, to a compressor portion 71 of a supercharger (turbo-charger) 70 disposed immediately behind the engine 20. The outlet 51*o* is connected, via a tube 51*c*, to an intake inlet 43*a* of the surge tank 43. The cooling unit 60 is a heat exchange unit accommodated in the case 51.

In FIG. 5, reference numerals 91 and 92 denote cooling water hoses connected to the inter-cooler 50.

Referring also to FIG. 4, an exhaust manifold 44 is connected to the exhaust port 20*b* of the engine 20. An exhaust outlet 44*o* (see FIG. 5) of the exhaust manifold 44 is connected to a turbine portion 73 of the turbo-charger 70.

In addition, as shown in FIGS. 1 and 2, exhaust gas, which has been used for rotating a turbine in the turbine portion 73, is discharged in water stream generated by the jet pump 30 via an exhaust pipe 74, an anti-counterflow chamber 75 for preventing counterflow of water (permeation of water in the turbo-charger 70 and the like) at the time of turn-over, a water muffler 76, and an exhaust/drainage pipe 77.

Referring to FIGS. 6 and 7, the crankshaft 21 of the engine 20 is rotatably supported, via plain metal 26, by a bearing portion 20*e* provided in a lower case 20*c* and an upper case 20*d* of the engine 20.

A rear end 21*a* of the crankshaft 21 is located between the engine cases 20*c* and 20*d*. The output shaft 22 is provided separately from the crankshaft 21 and is coupled to the rear end 21*a* of the crankshaft 21. A shaft 35 of the jet pump 30, which is the above-described propulsion device, is coupled to a rear end of the output shaft 22 via the coupling 80.

The output shaft 22 is rotatably supported by two rolling bearings (ball bearings in the example shown in the figures) 27*a* and 27*b*, which are mounted in the engine cases 20*c* and 20*d* in such a manner as to be immovable in a thrust direction (in the direction from right to left or from left to right in FIGS. 6 and 7). In the figure, reference numeral 28 denotes a seal member for preventing permeation of water in the engine 20, and 29*a*, 29*b* and 29*c* denote thrust receiving members interposed between the ball bearings and the engine cases.

Figure 8:
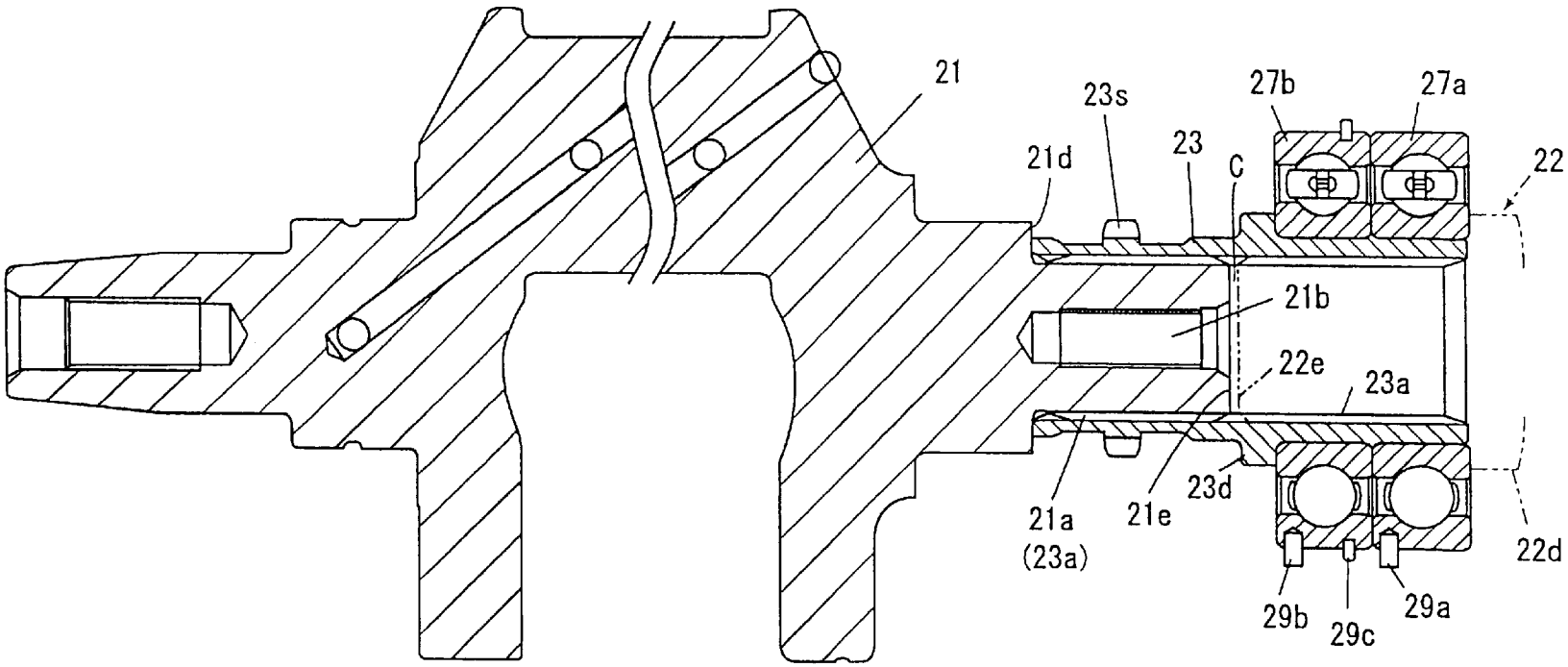
FIG. 8 is an enlarged view showing the crankshaft 21, a connection pipe 23, and the ball bearings 27*a* and 27*b;*
Figure 9A:
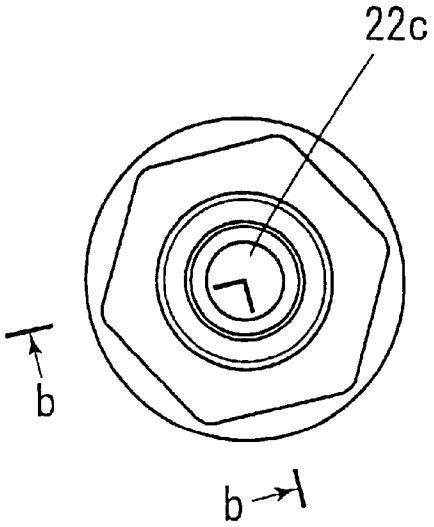
FIGS. 9(*a*) and 9(*b*) are views showing the output shaft 22, wherein FIG. 9(*a*) is an end view seen from rear, and FIG. 9(*b*) is a sectional view taken on line b—b of FIG. 9(*a*)
Figure 9B:
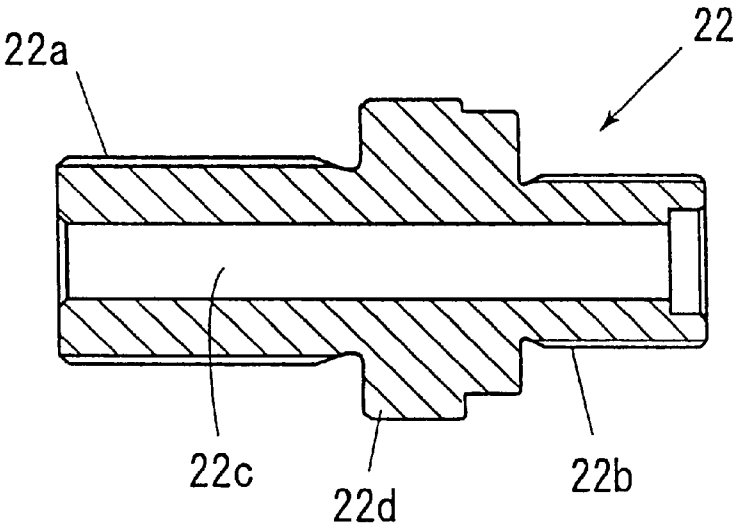
Figure 10A:
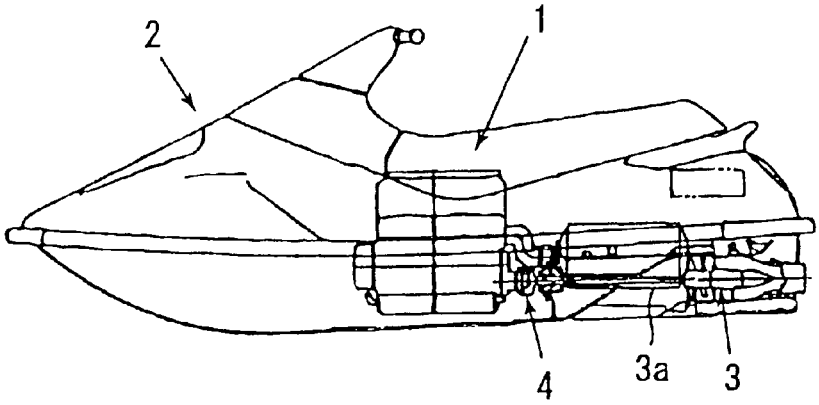
FIG. 10(a) BACKGROUND ART
FIGS. 10(*a*) and 10(*b*) are views illustrating a background art personal watercraft.
Figure 10B:
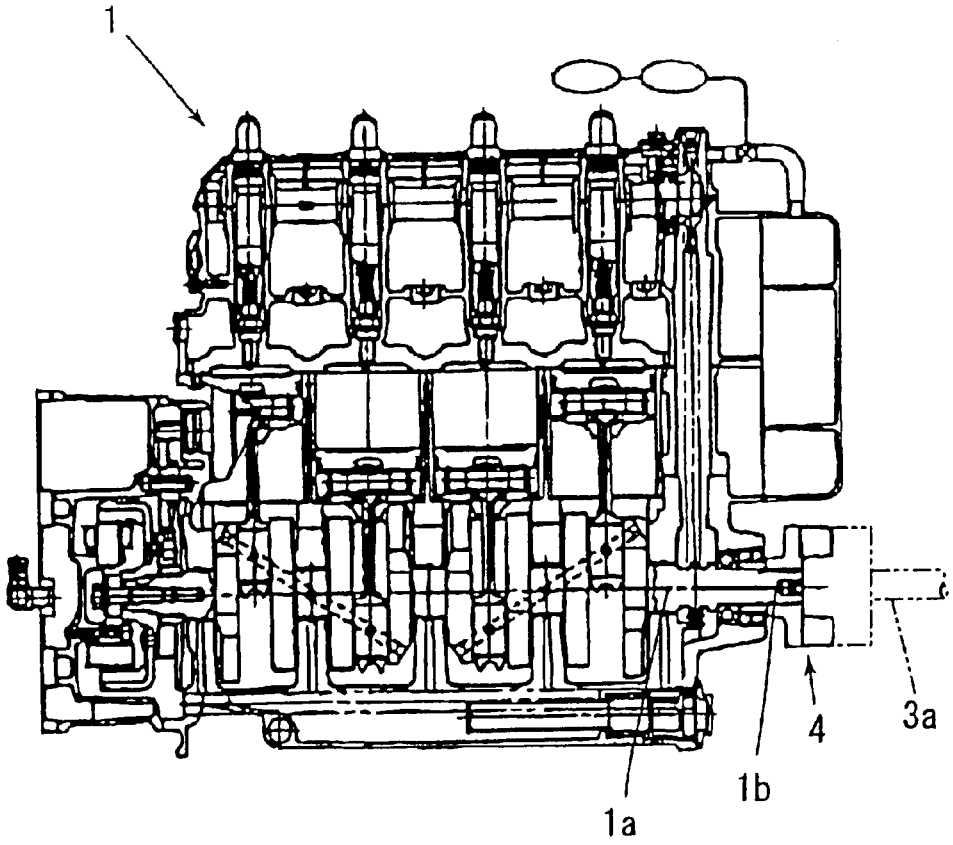
FIG. 10(b) BACKGROUND ART

FIG. 8 is an enlarged view showing the crankshaft 21, a connection pipe 23, and the ball bearings 27*a* and 27*b*. FIGS. 9(*a*) and 9(*b*) are views showing the output shaft 22, wherein FIG. 9(*a*) is an end view seen from rear, and FIG. 9(*b*) is a sectional view taken on line b—b of FIG. 9(*a*).

Referring to FIG. 7 to FIG. 9(*b*), a spline 21*a* is formed on or in the rear end of the crankshaft 21. A spline 22*a* is formed on or in a front end of the output shaft 22. The connection pipe 23 has, in or on its inner surface, a spline 23*a* for being engaged with the splines 21*a* and 22*a*. The rear end of the crankshaft 21 is thus coupled to the front end of the output shaft 22 via the connection pipe 23.

The output shaft 22 also has, on or in its rear end, a spline 22*b*. An output side coupling 81 (see FIG. 7) has, in or on an inner surface of a boss, a spline 81*a* for being engaged with the spline 22*b*. The output side coupling 81 is thus coupled to the rear end of the output shaft 22 by engaging the spline 22*b* on the output shaft 22 with the spline 81*a* on the output side coupling 81.

The output shaft 22, the connection pipe 23, and the bearings 27*a* and 27*b* are mounted to the crankshaft 21 by mounting the connection pipe 23 and the bearings 27*a* and 27*b* to the rear end of the crankshaft 21 as shown in FIG. 8. The output shaft 22 is then mounted in a rear portion of the connection pipe 23 as shown in FIG. 7. A bolt B is then inserted in a bolt insertion hole 22*c* formed in the output shaft 22 (see FIGS. 9(*a*) and 9(*b*)), and an external thread portion B1 at a leading end portion of the bolt B is threaded in a threaded hole 21*b* formed in the rear end of the crankshaft 21 (see FIG. 8). It should be noted that any threaded portion, in which the external thread portion B1 of the bolt B is to be screwed, is not formed in the output shaft 22 (see FIGS. 9(*a*) and 9(*b*)), and that the bolt B is only inserted in the output shaft 22.

The lower case 20*c* and the upper case 20*d* of the engine 20 are thus fastened to each other with bolts (not shown). This results in the crankshaft 21, the output shaft 22, the connection pipe 23, and the bearings 27*a* and 27*b* being assembled in the engine 20 as shown in FIGS. 6 and 7.

In such an assembled state, the connection pipe 23 is slightly clamped between a stepped portion 21*d* at the rear portion of the crankshaft 21 in the axial direction and a flange portion 22*d* of the output shaft 22. The wording "slightly clamped" means a state where the connection pipe 23 is clamped to such a degree as to allow the connection pipe 23 to be positioned without the occurrence of looseness between the stepped portion 21*d* at the rear portion of the crankshaft 21 and the flange portion 22*d* of the output shaft 22. On the other hand, the bearings 27*a* and 27*b* are slightly clamped between a flange portion 23*d* of the connection pipe 23 and the flange portion 22*d* of the output shaft 22. The wording "slightly clamped" means a state where the bearings 27*a* and 27*b* are clamped to such a degree as to allow the bearings 27*a* and 27*b* to be positioned between the flange portion 23*d* of the connection pipe 23 and the flange portion 22*d* of the output shaft 22. A gap C (see FIG. 7) is formed between opposed faces 21*e* and 22*e* of the rear end of the crankshaft 21 and the front end of the output shaft 22.

Accordingly, a thrust force F (see FIG. 7) from the shaft 35 of the jet pump 30 is mainly received, via the coupling 80 and the flange portion 22*d* of the output shaft 22, by the bearings 27*a* and 27*b* (and consequently, by the engine cases). In other words, the thrust force F is not directly applied to the crankshaft 21. However, if the thrust force is applied, it is slightly transmitted thereto via the connection pipe 23, i.e., indirectly (in a moderated state).

Referring again to FIGS. 6 and 7, a transmission chamber 20*g*, which accommodates a transmission mechanism (to be described below) for transmitting power of the crankshaft 21 to a cam shaft 20*f* of the engine 20, is provided in a rear portion of the engine 20, i.e., in a rear portion of the crankshaft 21. In the transmission chamber 20*g*, the rear end (21*a*) of the crankshaft 21 is coupled to the front end (22*a*) of the output shaft 22.

The transmission mechanism for transmitting power of the crankshaft 21 to the cam shaft 20*f* includes a drive sprocket 23*s* (see FIG. 8) integrated with the connection pipe 23. A driven sprocket 20*s* is provided on the cam shaft 20*f* in such a manner as to be rotatable with the cam shaft 20*f*. An endless chain (transmission chain) 20*h* is stretched between the drive sprocket 23*s* and the driven sprocket 20*s*. It is to be noted that the transmission mechanism may be configured by using a gear train. In this case, a drive gear may be integrally provided on the connection pipe 23, in place of the drive sprocket 23*s*.

The output shaft structure of the personal watercraft according to the present invention, configured as described above, has the following functions and effects:

The engine 20 is mounted on the watercraft body 11 with the crankshaft 21 of the engine 20 extending in the longitudinal direction of the watercraft body 11. The shaft 35 of the propulsion device 30 is coupled to the rear end of the crankshaft 21 in such a manner as to be disposed on an extension of the crankshaft 21. The crankshaft 21 is supported by the cases 20*c* and 20*d* of the engine 20 via plain metal 26. With this structure, the output shaft 22 provided separately from the crankshaft 21 is coupled to the rear end of the crankshaft 21. The shaft 35 of the propulsion device 30 is coupled to the rear end of the output shaft 22. The output shaft 22 is supported by the cases 20*c* and 20*d* of the engine 20 via the rolling bearings 27*a* and 27*b* immovable in a thrust direction. As a result, a thrust force F from the shaft 35 of the propulsion device 30 is mainly received by the output shaft 22 and the rolling bearings 27*a* and 27*b*. Therefore, the thrust force is not directly applied to the crankshaft 21. However, if the thrust force is applied to the crankshaft 21, it is transmitted thereto indirectly (in a moderated state).

Since the output shaft 22 provided separately from the crankshaft 21 is coupled to the rear end of the crankshaft 21 and the shaft 35 of the propulsion device 30 is coupled to the rear end of the output shaft 22, an anti-torque, a bending force, and vibration from the shaft 35 of the propulsion device 30 are not directly applied to the crankshaft 21. However, if applied to the crankshaft, they are transmitted thereto indirectly (in a moderated state). In particular, a bending force applied to the crankshaft 21 is significantly reduced.

As a result, according to this configuration of the output shaft structure of a personal watercraft, it is possible to reduce fatigue of the plain metal 26 for supporting the crankshaft 21, and hence to improve the durability of the engine 20.

The spline 21*a* is formed on or in the rear end of the crankshaft 21 and the spline 22*a* is also formed on or in the front end of the output shaft 22. The spline 23*a* for engaging with the splines 21*a* and 22*a* is formed in or on an inner surface of the connection pipe 23. The rear end of the crankshaft 21 is coupled to the front end of the output shaft 22 via the connecting pipe 23. As a result, it is possible to certainly transmit a power from the crankshaft 21 to the output shaft 22 via the connection pipe 23.

An anti-torque, a bending force, and vibration from the shaft 35 of the propulsion device 30 are transmitted from the output shaft 22 to the crankshaft 21 via the connection pipe 23. In this case, since each of the crankshaft 21 and the output shaft 22 is coupled to the connection pipe 23 by spline-fitting, the reaction force from the shaft 35 of the propulsion device 30, particularly, the bending force and vibration can be significantly reduced in the course of transmission from the output shaft 22 to the crankshaft 21 via the connection pipe 23.

As a result, according to this configuration of the output shaft structure of a Personal watercraft, it is possible to certainly transmit power from the crankshaft 21 to the output shaft 22 via the connection pipe 23 and to improve durability of the engine 20.

The gap C is formed between opposed faces 21*e* and 22*e* of the rear end of the crankshaft 21 and the front end of the output shaft 22. Accordingly, an anti-torque, a thrust force, a bending force, and vibration, particularly, a thrust force and a bending force transmitted from the shaft 35 of the propulsion device 30 to the crankshaft 21 can be significantly reduced. As a result, it is possible to more certainly improve the durability of the engine 20.

The rear end of the crankshaft 21 is located between the engine cases 20*c* and 20*d*. The output shaft 22 is provided separately from the crankshaft 21 and is coupled to the rear end of the crankshaft 21. The shaft 35 of the propulsion device 30 is coupled to the rear end of the output shaft 22. As a result, the crankshaft 21 can be shortened because the rear end of the crankshaft 21 is located between the engine cases 20*c* and 20*d*.

Accordingly, even if an anti-torque, a thrust force, a bending force, and vibration are applied in a complex combination to the crankshaft 21, the crankshaft 21 is bent less (less deflected).

As a result, the crankshaft 21 rotating at a high speed, the bearing portion 20*e* thereof, and the like are less fatigued. This makes it possible to further improve the durability of the engine 20.

The engine 20 is a four-cycle DOHC engine. The transmission chamber 20*g* where the transmission mechanism for transmitting a power from the engine 20 to the cam shaft 20*f* of the engine 20 is provided in a rear portion of the crankshaft 21. In the transmission chamber 20*g*, the rear end of the crankshaft 21 is coupled to the front end of the output shaft 22. As a result, it is possible to couple the rear end of the crankshaft 21 to the front end of the output shaft 22 by making effective use of a space in the transmission chamber 20*g*.

A drive sprocket 23*s* (or drive gear) of the transmission mechanism is integrally provided on the connection pipe 23. The provision of the drive sprocket 23*s* (or drive gear) of the transmission mechanism on the connection pipe 23 is easier than the provision of the drive sprocket 23*s* (or drive gear) of the transmission mechanism on the crankshaft 21.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An output shaft structure of a personal watercraft, wherein an engine is mounted on a watercraft body with a crankshaft of the engine extending in a longitudinal direction of the watercraft body, a shaft of a propulsion device is coupled to a rear end of the crankshaft of said engine in such a manner as to be disposed on an extension of the crankshaft, and the crankshaft is supported by an engine case via plain metal, said output shaft structure comprising:

an output shaft provided separately from the crankshaft, said output shaft being coupled to the rear end of the crankshaft, the shaft of the propulsion device being coupled to a rear end of said output shaft, and said output shaft is supported by the engine case via a rolling bearing immovable in a thrust direction;

a first spline being formed on or in the rear end of the crankshaft;

a second spline being formed on or in a front end of said output shaft; and a third spline engaging with said first and second splines and being formed in or on an inner surface of a connection pipe, and the rear end of the crankshaft is coupled to the front end of said output shaft via said connecting pipe.

2. The output shaft structure of a personal watercraft according to claim 1, wherein a gap is formed between opposed faces of the rear end of said crankshaft and the front end of said output shaft.

3. The output shaft structure of a personal watercraft according to claim 2, wherein the crankshaft includes a stepped portion formed thereon, said output shaft including a flange portion formed thereon, and said connection pipe is slightly clamped between said stepped portion and said flange portion.

4. The output shaft structure of a personal watercraft according to claim 1, wherein said output shaft includes a bolt insertion hole formed therein, the rear end of the crank shaft includes a threaded bolt hole formed therein, said output shaft structure further comprising a bolt inserted through said bolt insertion hole and into said threaded bolt hole, said bolt including a thread portion formed at a leading end portion thereof, said thread portion being threaded in said threaded bolt hole to couple said output shaft to the crankshaft.

5. The output shaft structure of a personal watercraft according to claim 1, wherein said output shaft includes a bolt insertion hole formed therein, the rear end of the crank shaft includes a threaded bolt hole formed therein, said output shaft structure further comprising a bolt inserted through said bolt insertion hole and into said threaded bolt hole, said bolt including a thread portion formed at a leading end portion thereof, said thread portion being threaded in said threaded bolt hole to couple said output shaft to the crankshaft.

6. The output shaft structure of a personal watercraft according to claim 5, wherein the crankshaft includes a stepped portion formed thereon, said output shaft including a flange portion formed thereon, and said connection pipe is slightly clamped between said stepped portion and said flange portion.

7. The output shaft structure of a personal watercraft according to claim 1, wherein the crankshaft includes a stepped portion formed thereon, said output shaft including a flange portion formed thereon, and said connection pipe is slightly clamped between said stepped portion and said flange portion.

8. A personal watercraft, comprising:

a watercraft body;

an engine mounted on said watercraft body with a crankshaft of said engine extending in the longitudinal direction of said watercraft body, said crankshaft being supported by an engine case via plain metal;

an output shaft, said output shaft being provided separately from said crankshaft and coupled to a rear end of said crankshaft, said output shaft being supported by said engine case via a rolling bearing immovable in a thrust direction;

a propulsion device, a shaft of said propulsion device being coupled to a rear end of said crankshaft in such a manner as to be disposed on an extension of said crankshaft, said shaft of said propulsion device being coupled to a rear end of said output shaft; and a first spline being formed on or in the rear end of said crankshaft;

a second spline being formed on or in a front end of said output shaft; and a third spline engaging with said first and second splines and being formed in or on an inner surface of a connection pipe, and the rear end of said crankshaft is coupled to the front end of said output shaft via said connecting pipe.

9. The personal watercraft according to claim 8, wherein a gap is formed between opposed faces of the rear end of said crankshaft and the front end of said output shaft.

10. The personal watercraft according to claim 9, wherein said crankshaft includes a stepped portion formed thereon, said output shaft including a flange portion formed thereon, and said connection pipe is slightly clamped between said stepped portion and said flange portion.

11. The personal watercraft according to claim 8, wherein said output shaft includes a bolt insertion hole formed therein, the rear end of said crank shaft includes a threaded bolt hole formed therein, said personal watercraft further comprising a bolt inserted through said bolt insertion hole and into said threaded bolt hole, said bolt including a thread portion formed at a leading end portion thereof, said thread portion being threaded in said threaded bolt hole to couple said output shaft to said crankshaft.

12. The personal watercraft according to claim 8, wherein said output shaft includes a bolt insertion hole formed therein, the rear end of said crank shaft includes a threaded bolt hole formed therein, said personal watercraft further comprising a bolt inserted through said bolt insertion hole and into said threaded bolt hole, said bolt including a thread portion formed at a leading end portion thereof, said thread portion being threaded in said threaded bolt hole to couple said output shaft to said crankshaft.

13. The personal watercraft according to claim 12, wherein said crankshaft includes a stepped portion formed thereon, said output shaft including a flange portion formed thereon, and said connection pipe is slightly clamped between said stepped portion and said flange portion.

14. The personal watercraft according to claim 8, wherein said crankshaft includes a stepped portion formed thereon, said output shaft including a flange portion formed thereon, and said connection pipe is slightly clamped between said stepped portion and said flange portion.

* * * * *